US006173753B1

(12) United States Patent
Laster-Bivens et al.

(10) Patent No.: US 6,173,753 B1
(45) Date of Patent: Jan. 16, 2001

(54) APPARATUS AND METHOD FOR HANGING SHADES AND CURTAINS

(75) Inventors: Linda Laster-Bivens, Powder Springs, GA (US); Diane Teel, Indian Trail, NC (US)

(73) Assignee: Visions By Two Sisters, Inc., Indian Trail, NC (US)

( * ) Notice: Under 35 U.S.C. 154(b), the term of this patent shall be extended for 0 days.

This patent is subject to a terminal disclaimer.

(21) Appl. No.: 09/349,585

(22) Filed: Jul. 9, 1999

Related U.S. Application Data

(63) Continuation of application No. 09/080,599, filed on May 18, 1998, now Pat. No. 6,056,035.

(51) Int. Cl.[7] ..... A47H 5/00

(52) U.S. Cl. ..... 160/84.01; 160/84.04; 160/178.1 R; 160/330

(58) Field of Search ..... 160/84.01, 84.04, 160/87.4, 168.1 R, 173 R, 178.1 R, 178.2 R, 330, 345, 368.1; 248/263; 211/105.1

(56) References Cited

U.S. PATENT DOCUMENTS

| | | | | |
|---|---|---|---|---|
| 978,220 | * | 12/1910 | Sarkisian | 160/84.1 |
| 3,439,725 | * | 4/1969 | Haimovitz et al. | 160/84.1 |
| 4,635,698 | * | 1/1987 | Anderson | 160/178.1 R |
| 4,667,723 | * | 5/1987 | Spangenberg | 160/178.1 R X |
| 4,877,075 | * | 10/1989 | Markowitz | 160/84.1 |
| 4,899,796 | * | 2/1990 | Easley et al. | 160/84.1 |
| 4,976,301 | * | 12/1990 | Easley et al. | 160/84.1 |
| 5,331,992 | * | 7/1994 | Gremont | 135/102 |
| 5,673,741 | * | 10/1997 | Cairns | 160/330 |
| 5,862,850 | * | 1/1999 | Yang | 160/84.04 |
| 5,915,442 | * | 6/1999 | Prosch | 160/84.01 |
| 5,996,667 | * | 12/1999 | Fun | 160/84.01 |
| 6,056,035 | * | 5/2000 | Laster-Bivens | 160/84.01 |

FOREIGN PATENT DOCUMENTS

| | | | | |
|---|---|---|---|---|
| 15751 | * | 9/1910 | (GB) | 160/178.2 R |

* cited by examiner

*Primary Examiner*—Bruce A. Lev
(74) *Attorney, Agent, or Firm*—Thomas, Kayden, Horstemeyer & Risley, L.L.P.

(57) ABSTRACT

A shade and curtain hanging system comprising a shade and curtain hanging apparatus. The apparatus includes an elongated hanging bracket mountable to a window box or wall and a string arrangement member having a plurality of openings provided therein that are sized and shaped to permit the passage of individual draw strings therethrough. With this apparatus, a user can attach the hanging bracket at an installation point, thread a plurality of draw strings through the openings provided in the string arrangement member at predetermined points along the length of the member, thread the draw strings along string paths provided on the shade or curtain, secure the ends of the draw strings, mount the string arrangement member to the hanging bracket, and attach the shade or curtain to the hanging bracket.

18 Claims, 4 Drawing Sheets

APPARATUS AND METHOD FOR HANGING SHADES AND CURTAINS

CROSS REFERENCE TO RELATED APPLICATION

This application is a continuation of U.S. patent application Ser. No. 09/080,599, filed May 18, 1998, now U.S. Pat. No. 6,056,035.

FIELD OF THE INVENTION

The invention relates generally to a shade and curtain hanging system. More particularly, the invention relates to a hanging system which includes a arrangement member having a plurality of openings that permit the hanging of various types of shades or curtains without structural modification of the system hardware.

BACKGROUND OF THE INVENTION

The most popular form of shade or curtain is the rod-pocket type. With the rod-pocket configuration, the shade or curtain is provided with an elongated pocket or a plurality of loops along the upper edge of the shade or curtain through which an aluminum or wooden rod is extended. Once the rod is so positioned, it is mounted to a wall or inside a window box with mounting brackets that are already secured to the wall or window box.

One major reason for the popularity of the rod-pocket configuration is the simplicity of its design. Specifically, these shades or curtains open laterally as opposed to vertically and, therefore, require few draw strings and draw string connections to the shade or curtain. The structural simplicity permits the user to easily remove the existing shade or curtain to clean it, or replace it altogether, with another rod-pocket shade or curtain.

Despite simplifying the installation and removal process, rod-pocket shades and curtains are limited in styling. For example, more decorative shade or curtain styles such as Roman, Austrian, balloon, and cloud cannot be used with conventional rod-pocket apparatus since these styles typically require two or more vertically-pulling draw strings that are positioned in predetermined positions along the lateral extent of the shade or curtain. To form Roman, Austrian, balloon, and cloud shades or curtains, the user normally must use a wooden mounting board that is provided with several eye screws secured in positions that correlate with string paths of the shade or curtain. In preparing to hang the shade or curtain, the eye screws must be secured to the mounting board in the correct location and number to match the particulars of the shade or curtain to be hung. Although not exceedingly difficult to install and remove, this apparatus can complicate the changing of the shade or curtain. In particular, when the user wishes to replace an existing shade or curtain with another, the eye screws usually must be removed and repositioned to accommodate the new shade or curtain or the entire mounting board must be removed and replaced with a newly configured mounting board.

In an effort to alleviate the difficulty in installing and removing different Roman, Austrian, balloon, cloud, and similarly styled shades or curtains, several different hanging devices have been devised. For example, U.S. Pat. No. 4,909,297, issued to Koller et al., discloses a balloon shade hanging apparatus that uses a curtain rod and cord eyelets that are releasably positionable along the length of the rod. Despite permitting the user to hang balloon shades, this design is undesirable for heavier shades and curtains because of the likelihood of the rod bending or breaking the thin wall mounting brackets under the weight of the shade or curtain. Additionally, the complexity of the design increases manufacturing costs and complicates installation.

In U.S. Pat. No. 5,109,908, Chen describes a curtain assembly device that uses a plurality of roller brackets positionable along the length of a support member. Although providing for vertical drawing of the curtain, the Chen design likewise employs intricate parts and is complex in configuration and operation.

From the above, it can be appreciated that it would be desirable to have apparatus that is simple in construction and operation which provides vertical drawing of decorative shades and curtains, and easy changing of styles of the shades or curtains.

SUMMARY OF THE INVENTION

The present invention relates to a shade and curtain hanging system comprising shade and curtain hanging apparatus. The apparatus includes an elongated hanging bracket mountable to a window box or wall and a string arrangement member having a plurality of openings provided therein that are sized and shaped to permit the passage of individual draw strings therethrough.

To use the hanging system, the user attaches the hanging bracket at an installation point, threads a plurality of draw strings through the openings provided in the string arrangement member at predetermined points along the length of the member that correspond to the shade or curtain to be hung, thread the draw strings along string paths provided on the shade or curtain, secure the ends of the draw strings to prevent removal of the strings from the shade or curtain, mounting the string arrangement member to the hanging bracket, and attach the shade or curtain to the hanging bracket.

The features and advantages of this invention will become apparent upon reading the following specification, when taken in conjunction with the accompanying drawings. It is intended that all such additional features and advantages be included therein with the scope of the present invention, as defined by the claims.

DETAILED DESCRIPTION

Figure 1:
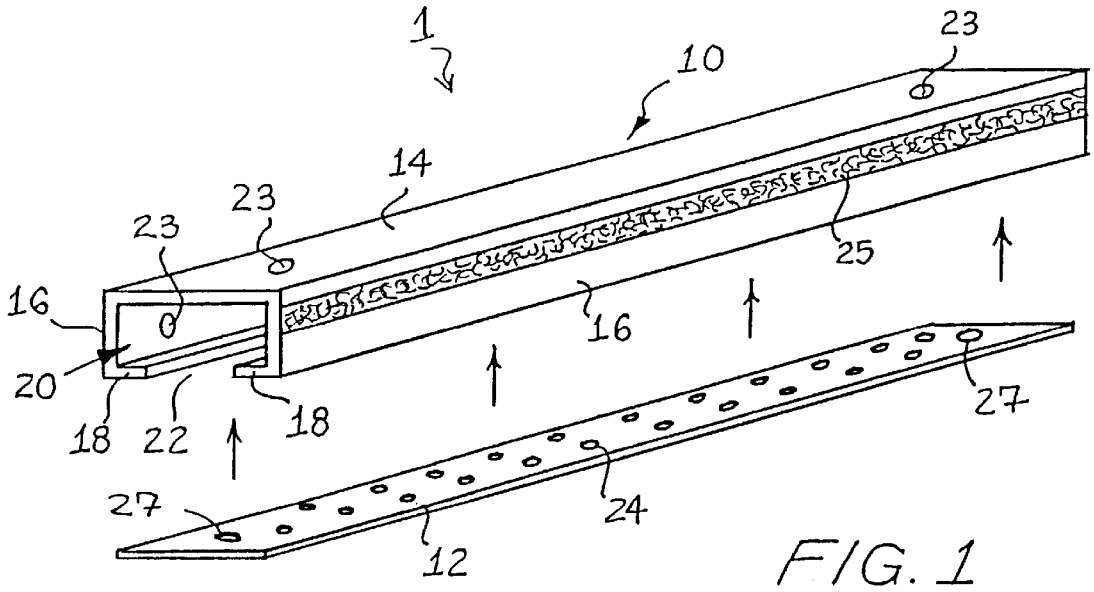
FIG. 1 is a perspective view of an embodiment of the hanging system constructed in accordance with the present invention.

Referring now in more detail to the drawings, in which like numerals indicate like parts throughout the several views, FIGS. 1–4 illustrate the structure and usage of an embodiment of a shade and curtain hanging system 1 constructed in accordance with the present invention. As shown in FIG. 1, the hanging system 1 generally comprises an elongated hanging bracket 10 and an elongated string arrangement member 12. The elongated hanging bracket 10 includes a top wall 14, opposed side walls 16, and opposed lower flanges 18. The side walls 16 extend downwardly in a generally parallel configuration to each other from the top wall 14 such that the bracket 10 is substantially U-shaped in cross-section and forms a hollow inner space 20. The opposed lower flanges 18 extend horizontally inward from the side walls 16 forming an opening 22 therebetween and partially enclosing the hollow inner space 20.

Typically provided in the top wall 14 and one of the opposed side walls 16 are mounting holes 23 which provide alternative mounting options for the installer. In addition, hook and loop fastening material 25 is provided across one of the side walls. This material 25 is adapted to mate with similar hook and loop fastening material which is provided on the shade or curtain to be hung. It is to be noted, however, that while hook and loop fastening material 25 is preferred, other conventional releasable fasteners can be used in lieu of the hook and loop material. Usually, the bracket 10 is composed of a rigid material such as metal, polymeric material, wood, or the like. When metal is used, preferred is a strong, lightweight metal such as aluminum. When a polymeric material is used, preferred is a durable polymer such as polyethylene.

Figure 2:
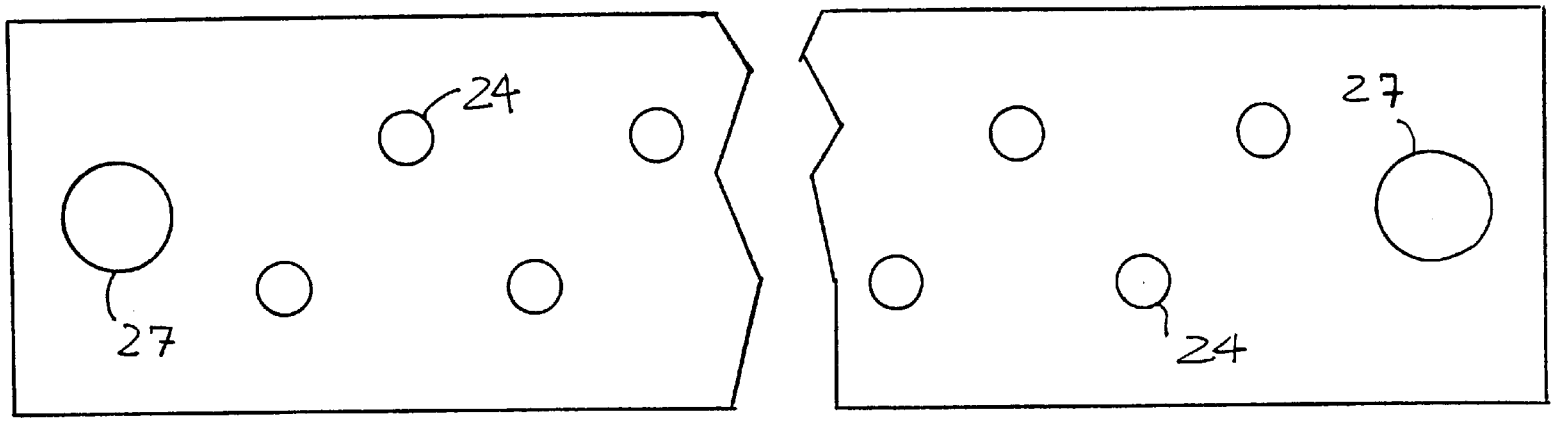
FIG. 2 is a frametary view of a string arrangement member shown in FIG. 1.

As illustrated in FIG. 1, the elongated string arrangement member 12 is normally substantially thin and rectangular in shape. Typically, the arrangement member 12 is approximately the same length as the elongated hanging bracket 10 and, as will be discussed in more detail below, is sized and shaped to fit within the hollow inner space 20 formed in the elongated hanging bracket 10. Depicted in FIG. 2, the arrangement member 12 has a plurality of apertures or openings 24. These openings 24 are sized and shaped to permit the passage of individual draw strings therethrough. Normally, the arrangement member 12 comprises a panel composed of a low friction polymeric material such as polyethylene. As shown in FIG. 2, the openings 24 normally are configured in a staggered arrangement with each opening 24 being approximately 0.25 inches in diameter. In addition to these openings 24, relatively large openings 27 are provided at each end of the arrangement member 12 to permit the passage of a plurality of draw strings. In a preferred arrangement, these relatively large openings 27 are approximately 0.5 inches in diameter. Although preferably formed as a panel provided with such openings, it will be understood that the arrangement member 12 could be formed of other materials and in other configurations as long as a plurality of openings are provided therein and the member is of adequate rigidity to support the shade or curtain.

Figure 3:
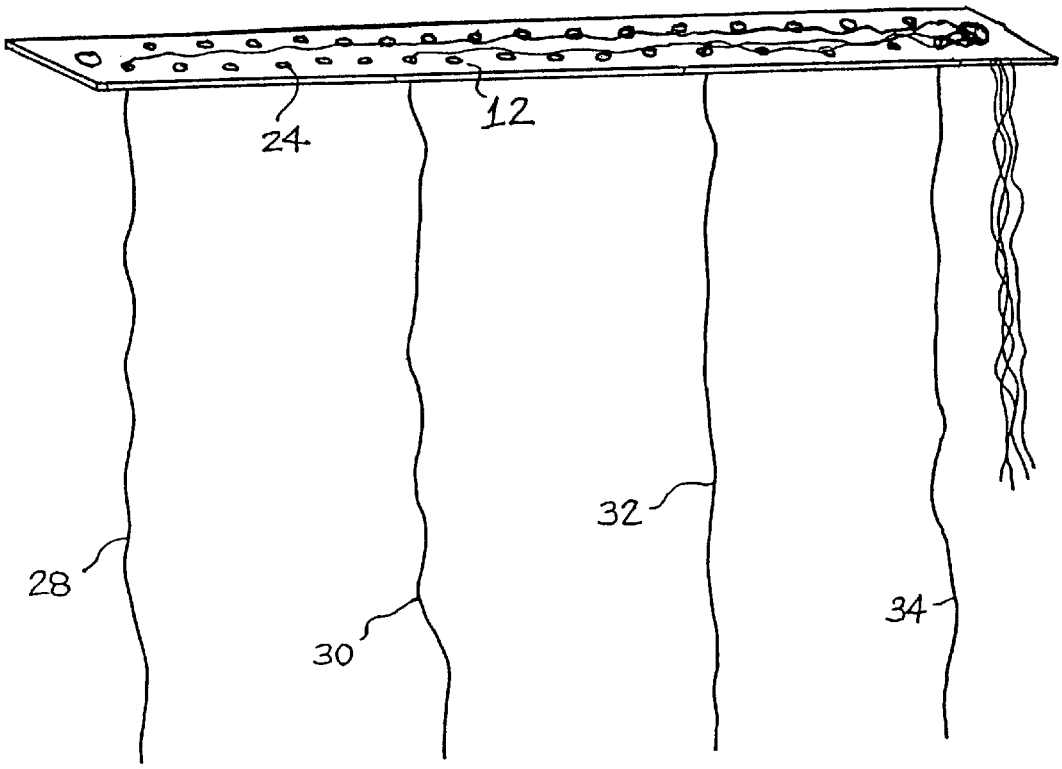
FIG. 3 is a schematic perspective view of the arrangement member with draw strings threaded therein.

FIG. 3 illustrates example preparation of the string arrangement member 12 for installation of a shade or curtain. As shown in this figure, a plurality of draw strings 28, 30, 32, and 34 are threaded through the openings 24 provided at one end of the arrangement member 12. Each individual string is again threaded through the arrangement member 12 at discrete predetermined positions along the length of the member. The location of these positions, as well as the number of draw strings used, is dictated by the particulars of the shade or curtain to be hung. For instance, in FIG. 4, four separate string paths 36 are provided in the shade 38 and, accordingly, four separate draw strings are threaded through the arrangement member 12.

Figure 4:
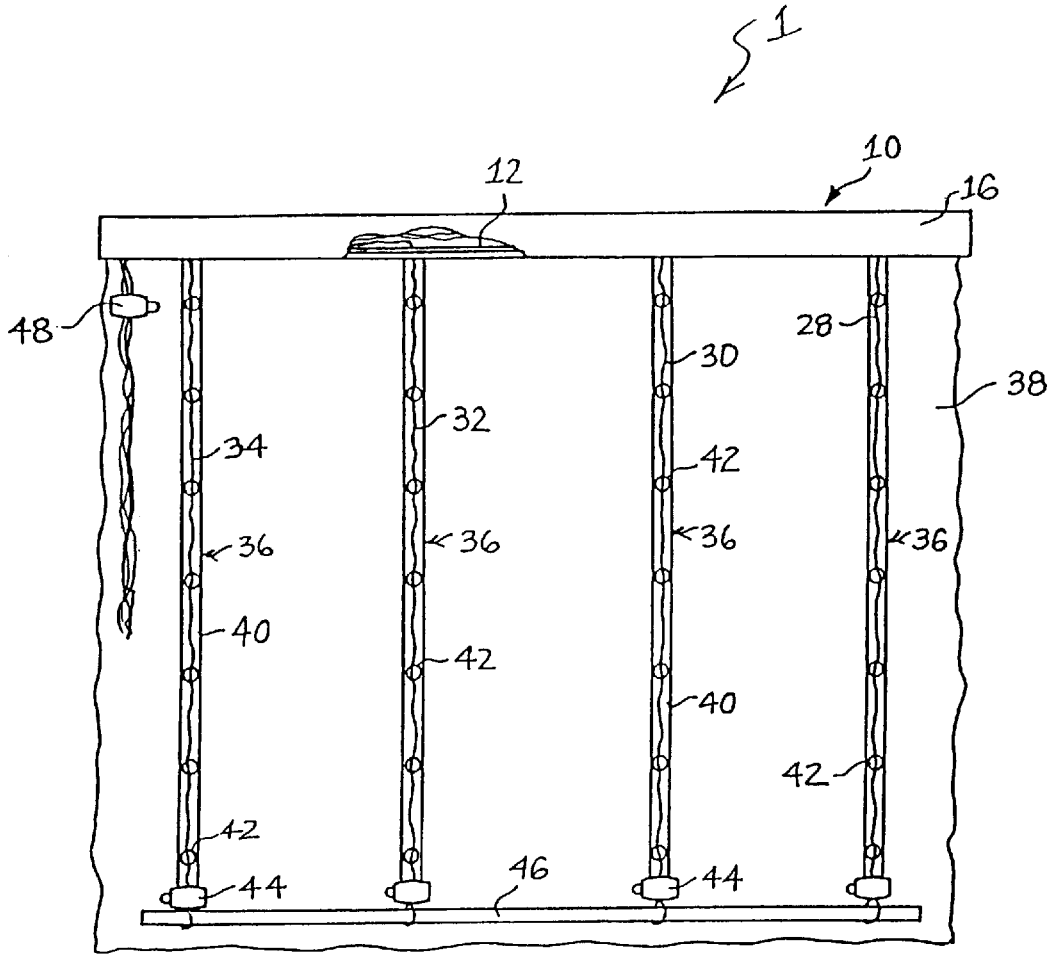
FIG. 4 is a partial cut-away view of the hanging system shown in FIG. 1, depicted with a shade or curtain installed thereon.

Once the draw strings 28, 30, 32, and 34 have been correctly threaded through the string arrangement member 12, the shade or curtain 38 can then be threaded onto the draw strings. As indicated in FIG. 4, the shade or curtain 38 typically will have a plurality of string paths 36 formed by narrow tape strips 40 having spaced attachment rings 42. Normally, these rings are spaced approximately every 6 to 8 inches along the length of the tape strips. After the draw strings have been threaded along the string paths, each individual string is secured at its end with a quick release cord stop 44. Normally, each string is first folded over to form a loop before the cord stop is applied so that a dowel rod 46 can be threaded through the loops at the end of the draw strings. As is known in the art, the addition of a dowel rod 46 provides weight and form to the shade or curtain to improve its appearance and hanging attributes. Normally, the bundled draw strings at the end of the string arrangement member 12 are secured together with a quick release cord stop 48 to ensure even pulling of the shade or curtain with the strings and to improve appearance. As is further known in the art, these strings can be secured to, for example, a conventional wall cleat, if desired.

After the shade or curtain 38 has been secured with the draw strings 28, 30, 32, and 34, the string arrangement member 12 can be inserted into the hanging bracket 10 as indicated by the directional arrows of FIG. 1. Normally, however, the hanging bracket 10 is first installed at the installation site by fastening the hanging bracket inside a window box or to the wall above the window box. In that the arrangement member 12 is sized and shaped to fit within the hanging bracket 10 and rest upon the opposed lower flanges 18 of the bracket (FIG. 4), the string arrangement member is tilted downwardly or upwardly with respect to the user during installation such that the member can pass through the bracket opening 22 and into the hollow inner space 20 and then rest atop the flanges 18. When so positioned, the arrangement member 12 extends across the opening 22 from one flange to the other. Once the arrangement member 12 is placed on top of the flanges 18, the top edge of the shade or curtain is releasably affixed to the front surface of the hanging bracket 10 with the hook and loop fastening material or other fasteners to complete installation of the shade or curtain.

So described, the shade and curtain hanging system 1 of the present invention greatly simplifies the shade or curtain installation and removal process. In a matter of minutes, the string arrangement member 12 and shade or curtain can be threaded and the member inserted into the hanging bracket 10 without the need of tools. Since the hanging arrangement member 12 is separate from the hanging bracket 10, threading the draw strings can be easily accomplished at a work space remote from the point of installation. Moreover, in that there are a multiplicity of openings provided in the arrangement member 12, many different string configurations are possible. The system user can, therefore, quickly and easily switch from one shade or curtain style to a totally different shade or curtain style without having to use a different mounting bracket or having to structurally reconfigure the mounting bracket.

While preferred embodiments of the invention have been disclosed in detail in the foregoing description and drawings, it will be understood by those skilled in the art that variations and modifications thereof can be made without departing from the spirit and scope of the invention as set forth in the following claims. For example, although the system has been described in relation to particular styles of shades and curtains, it is to be appreciated that the system of the present invention can be used with nearly any type of vertically drawn shade or curtain.

What is claimed is:

1. A window treatment hanging system, comprising:

an elongated hanging bracket mountable to a window box or wall;

a string arrangement member having a plurality of openings provided therein, said openings being sized and shaped to permit the passage of individual draw strings therethrough; and a plurality of draw strings being sized and shaped to thread through said openings provided in said string arrangement member such that said draw strings can be threaded through said string arrangement member at predetermined points along the length of said string arrangement member to correctly align with the window treatment to be hung.

2. The system of claim 1, wherein said hanging bracket includes a hollow inner space and an opening leading thereto, said opening being defined by opposed flanges, said string arrangement member being sized and shaped to fit within said hollow inner space of said hanging bracket so as to be supported by said hanging bracket flanges.

3. The system of claim 1, wherein said elongated hanging bracket is substantially U-shaped in cross-section.

4. The system of claim 1, wherein said elongated hanging bracket includes opposed lower flanges that define an opening therebetween, said lower flanges capable of supporting said string arrangement member such that said string arrangement member spans said opening.

5. The system of claim 1, wherein said string arrangement member comprises a panel of material.

6. The system of claim 5, wherein said panel is constructed of a low friction polymeric material.

7. The system of claim 1, further comprising a plurality of quick release cord stops that are releasably securable to said draw strings.

8. The system of claim 1, wherein said elongated hanging bracket is provided with hook and loop fastening material for attaching a top edge of the window treatment to said mounting bracket.

9. The system of claim 1, further including a dowel rod that secures to the window treatment with said draw strings to provide weight and form to the shade or curtain.

10. A window treatment hanging apparatus, comprising:

an elongated hanging bracket mountable to a window box or wall, said hanging bracket having a hollow inner space and an opening leading thereto, said opening being defined by opposed flanges; and an string arrangement member having a plurality of openings provided therein, said string arrangement member being sized and shaped to fit within said hollow inner space of said hanging bracket and rest upon said opposed flanges, said openings being sized and shaped to permit the passage of individual draw strings therethrough.

11. The apparatus of claim 10, wherein said elongated hanging bracket is substantially U-shaped in cross-section.

12. The apparatus of claim 10, wherein said string arrangement member comprises a panel of material.

13. The apparatus of claim 12, wherein said panel is constructed of a low friction polymeric material.

14. The apparatus of claim 10, wherein said elongated hanging bracket is provided with hook and loop fastening material for attaching a top edge of a window treatment to said mounting bracket.

15. A method for hanging a window treatment, said method comprising:

attaching a hanging bracket at an installation point;

threading a plurality of draw strings through openings provided in a string arrangement member at predetermined points along the length of the member that correspond to the window treatment to be hung;

threading the draw strings along string paths provided on the window treatment;

securing the ends of the draw strings to prevent removal of the strings from the window treatment;

mounting the string arrangement member to the hanging bracket; and attaching the window treatment to the hanging bracket.

16. The method of claim 15, wherein the step of mounting the string arrangement member to the hanging bracket comprises inserting the member into the hanging bracket and resting the member on opposed flanges provided on the hanging bracket.

17. The method of claim 15, wherein the step of securing the ends of the draw strings is accomplished with quick release cord stops.

18. The method of claim 15, further including the step of securing a rod to the ends of the draw strings to provide weight and form to the lower edge of the window treatment.

* * * * *